United States Patent [19]

Stout

[11] 3,999,341

[45] Dec. 28, 1976

[54] COMPOSITE CONCRETE STRUCTURE AND METHOD OF MAKING SAME

[76] Inventor: Robert K. Stout, Nizza 12, Mexico City, Mexico

[22] Filed: Sept. 29, 1975

[21] Appl. No.: 617,283

[52] U.S. Cl. ..... 52/221; 52/100; 52/332; 52/381; 52/577; 264/35

[51] Int. Cl.[2] ..... E04C 2/10; E04B 5/48

[58] Field of Search ..... 52/100, 309, 220, 221, 52/332, 329, 381, 323, 382, 576, 577; 264/35, 261

[56] References Cited

UNITED STATES PATENTS

| | | | |
|---|---|---|---|
| 1,033,461 | 7/1912 | Peterson | 52/381 X |
| 1,845,772 | 2/1932 | Venzie | 52/332 X |
| 2,358,147 | 9/1944 | Colburn | 52/332 X |
| 3,334,458 | 8/1967 | Leemhuis | 52/381 X |
| 3,382,637 | 5/1968 | Longinotti | 52/309 X |
| 3,826,052 | 7/1974 | Tenorio | 52/309 X |
| 3,835,606 | 9/1974 | Liberman | 52/221 X |
| 3,885,296 | 5/1975 | Stout | 52/221 X |
| 3,908,323 | 9/1975 | Stout | 52/100 X |
| 3,908,324 | 9/1975 | Stout | 52/100 |

FOREIGN PATENTS OR APPLICATIONS

| | | | |
|---|---|---|---|
| 533,459 | 12/1954 | Belgium | 52/329 |
| 217,478 | 6/1924 | United Kingdom | 52/329 |

*Primary Examiner*—Alfred C. Perham
*Attorney, Agent, or Firm*—Anthony J. Casella

[57] ABSTRACT

An architecturally finished concrete structure is a composite of a finished wallboard member, such as plasterboard, plywood, etc., to which is bonded a plurality of elongated hollow void creating devices, with said devices being embedded in a concrete structure that is adhered to said finished wallboard member. In the subject method, one side, or both sides, of the concrete form for casting-in-place the concrete structure is defined by a finished wallboard member to which is adhered a plurality of elongated hollow void creating devices. Concrete is poured in the space defined by the concrete form, and is cured so as to be in intimate contact with, and embed, the void creating devices, and the resulting concrete structure is architecturally finished by having one or both faces thereof formed of said wallboard member.

9 Claims, 5 Drawing Figures

COMPOSITE CONCRETE STRUCTURE AND METHOD OF MAKING SAME

CROSS-REFERENCES TO RELATED APPLICATIONS

The subject invention is related to the following corresponding applications of the applicant: 1. U.S. application Ser. No. 399,087 filed Sept. 20, 1973 and entitled "CONCRETE STRUCTURE INCLUDING MODULAR CONCRETE BEAM AND METHOD OF MAKING SAME," now U.S. Pat. No. 3,908,324, issued Sept. 30, 1975; 2. U.S. application Ser. No. 487,604 filed July 11, 1974 and entitled "VOID CREATING DEVICE TO BE EMBEDDED IN A CONCRETE STRUCTURE," now U.S. Pat. No. 3,908,323, issued Sept. 30, 1975; and 3. U.S. application Ser. No. 487,605 filed July 11, 1974 and entitled "METHOD FOR MAKING CAST-IN-PLACE CONCRETE STRUCTURE", now U.S. Pat. No. 3,885,296, issued May 27, 1975; the disclosures of which are incorporated herein by reference.

BACKGROUND AND SUMMARY OF THE INVENTION

The present invention relates to an architecturally finished concrete structure, and the process for making same including the step of casting the structure in-place.

More particularly, the concrete structure of the subject invention is a composite of an architecturally finished wallboard member, a plurality of internal hollow void creating devices, and concrete, with the resulting structure having the desirable characteristics of: improved weight-strength ratio by reducing the unnecessary concrete in the structure; being architecturally finished on one or both sides, thereby minimizing the amount of finishing required; effective insulation of the concrete structure; increased fire rating; more efficient sound transmission properties; and with all of these results achieved with the subject process which greatly reduces labor requirements, material requirements, and elapsed time for the construction of the structure, all of which result in significant cost reduction.

Prior art systems for casting-in-place concrete structures usually require, in the case of vertical walls, the employment of two opposed temporary forms into which the concrete is poured. Following curing of the concrete, the temporary forms are removed and the opposed surfaces of the concrete structure are architecturally finished, for instance by the application thereto of wallboard, plasterboard, plywood, or the like. In most instances an array of furring strips are applied to the concrete structure in order to provide a nailing surface into which the nails for holding the wallboard may be attached. As is readily apparent, the employment of the concrete forms, the application of the furring strips, and the time required for applying the wallboard member greatly increases the cost of construction.

The present invention overcomes the shortcoming of prior art techniques to produce an architecturally finished concrete structure by providing an architecturally finished concrete structure and a method of making the same wherein a finished wallboard member forms a portion of the concrete form, and wherein void creating devices are first bonded to the finished wallboard member, after which uncured concrete is poured into the planar concrete form and cures in intimate contact with the void creating devices and one side of the finished wallboard member to form a composite structure. When employing the subject process, the finished wallboard member has the dual function of defining the concrete form into which the uncured concrete is to be poured, as well as becoming part of the resulting composite structure following curing of the concrete. The wallboard also functions to maintain the elongated hollow void creating devices in place during the casting-in-place operation since the void creating devices are previously bonded to the finished wallboard. Uncured concrete flows in and around the exposed portions of the void creating devices, and is bonded thereto as well as to one surface of the finished wallboard member, thereby forming an integral concrete structure. The latter has the advantages set forth above, and in addition, the subject process eliminates the requirement for employing standard concrete forms, thereby reducing the amount of time and equipment necessary for forming the architecturally finished concrete structure.

DESCRIPTION OF THE PREFERRED EMBODIMENTS

Before describing the several embodiments of the subject invention it should be noted that although the detailed description refers to a building structure such as a house, any other type of enclosure which may be made utilizing concrete structures and defined by the subject process may be made according to the teachings of the invention. Accordingly, it is contemplated that building structures such as industrial buildings, warehouses, apartment houses, stores and the like are included within the scope of the invention.

Figure 1:
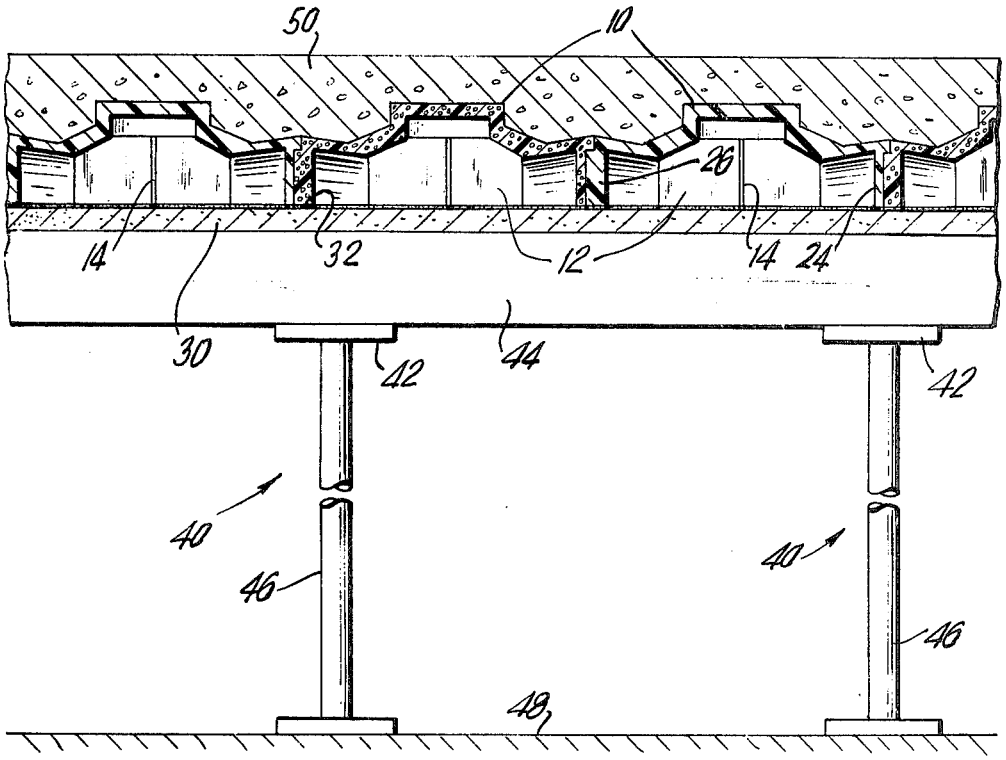
FIG. 1 illustrates an architecturally finished ceiling of the subject invention, and one step in the process of the invention.
Figure 2:
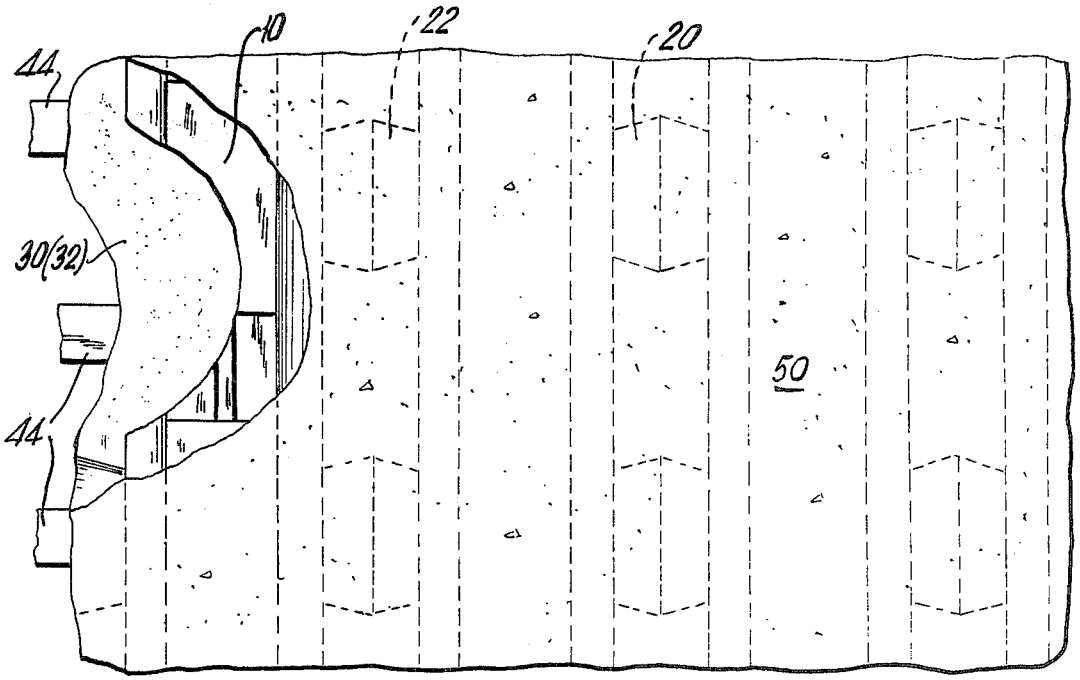
FIG. 2 is a plan view, partially in section, of the ceiling illustrated in FIG. 1.

One of the steps in the subject process for making an architecturally finished structure which is cast-in-place is the placing of void creating devices within the confines of a planar concrete form. The void creating devices may be of the type described in U.S. patent application Ser. No. 487,604 which was filed in July 11, 1974 and is entitled "Void Creating Device To Be Embedded In A Concrete Structure," now U.S. Pat. No. 3,908,323. For the construction of a generally horizontal concrete structure, such as a ceiling or floor of a building, only one half of the elongated void creating device may be required (see FIGS. 1 and 2), whereas in the construction of generally vertical walls, two interfitting elongated sections may be employed (see FIGS. 3 through 5). As shown in the embodiment of FIGS. 1 and 2, the void creating device is a generally elongated, hollow member 10 which is preferably of integral, molded construction, and made of a frangible material such as polystyrene foam. The opposed ends, as well as the intermediate sections of the elongated member 10 may be closed by means of baffles 12, with the latter including lines 14 of reduced thickness in order to facilitate the removing or knocking out of the baffles 12 when it is desired to gain access to the interior of the resulting concrete structure for the passage of service lines or the like, as more fully described hereinafter.

Disposed intermediate the length of the device 10 is at least one pair of opposed projections 20, 22 that are hollow and include closure baffles 24 and 26, respectively, that may likewise be knocked out or removed in order to enable passage of service lines into the interior of the void creating device 10. The opposed projections 20 and 22 are configured in a tongue and groove configuration in order to enable the interconnection and interfitting of adjacent void creating devices 10.

As shown in FIG. 1, the void creating devices 10 are in abutting relationship, although in certain instances where it is not necessary to provide two-dimensional ducting of service lines or the like, and wherein structural requirements dictate, the void creating devices may be spaced relative to each other in order to achieve an improved weight-strength ratio.

In the subject process for making a horizontal concrete structure, such as the ceiling of a building, the first step includes bonding a plurality of elongated hollow void creating devices 10 to a finished wallboard member 30. As shown in FIG. 1, this may be achieved by a suitable adhesive, designated by the number 32, and although the void creating devices shown in FIG. 1 are in abutting relationship, such devices may be spaced along the width of the finished wallboard member 30, when desired. Next, a planar concrete form is erected by laying the wallboard member 30 in a generally horizontal position, and supporting said wallboard member 30 by a shoring means, generally designated by the numeral 40. The shoring means 40 may include shoring beams 42 and 44 running at right angles, and a suitable number of vertical support jacks 46 bearing against the lower floor or ground surface 48.

The finished wallboard member 30 bears against the shoring member 44, with the void creating devices being disposed within the planar concrete form. In the next step, the concrete structure is formed by pouring uncured concrete 50 into the space defined by the planar concrete form, and more particularly in the space between the projections 20 and 22 of the void creating devices and the wallboard member 30, which concrete is poured to sufficiently cover the entire array of elongated hollow void creating devices 10, as more particularly shown in FIG. 1. It is noted that the planar concrete form is defined by one side of the finished wallboard member, and the concrete intimately contacts the wallboard member 30, as well as embedding within and being in intimate contact with the void creating devices 10. After the concrete has cured, the shoring means 40 are removed, and the wallboard member 30, being bonded to the void creating devices and to the cured concrete, becomes an integral part of the architecturally finished concrete structure. It is noted that the wallboard members 30 serve the dual functions of providing the planar concrete form into which the uncured concrete is poured, as well as becoming part of the resulting composite concrete structure following curing of the concrete. In addition, since the void creating devices are bonded to the wallboard, the latter also functions to maintain the hollow void creating devices 10 in place during the casting-in-place operation. It is only necessary to remove the shoring means 40, following curing of the concrete, whereby the resulting concrete structure is architecturally finished on the lower portion thereof in which the wallboard is disposed. As is apparent, there is no necessity for additional form structures for defining the lower portion of the planar concrete form in which the concrete structure is cast-in-place, since the wallboard member 30 achieves that function.

Figure 3:
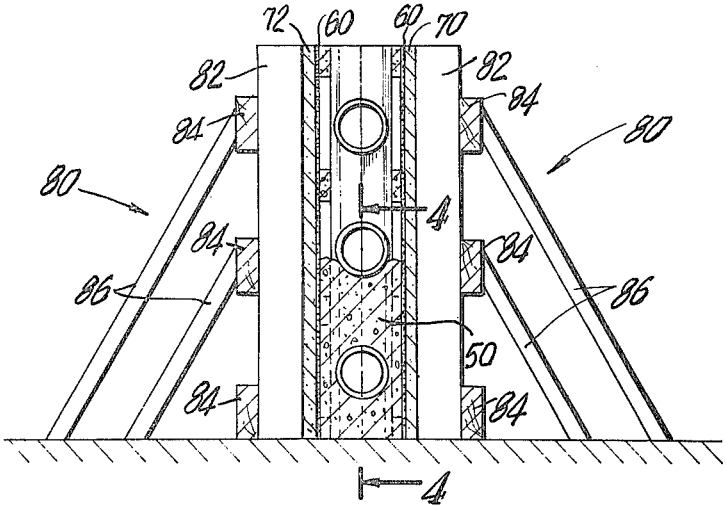
FIG. 3 is a sectional view illustrating a vertical wall made according to one embodiment of the subject invention.
Figure 4:
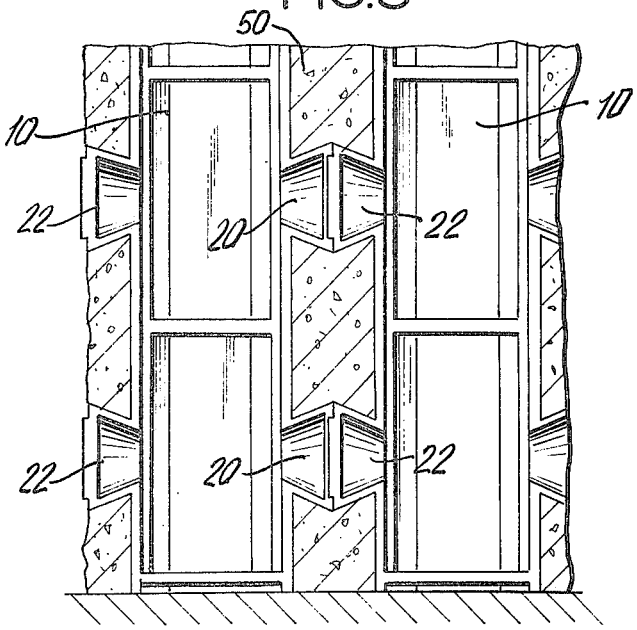
FIG. 4 is a sectional view taken along line 4—4 in FIG. 3.
Figure 5:
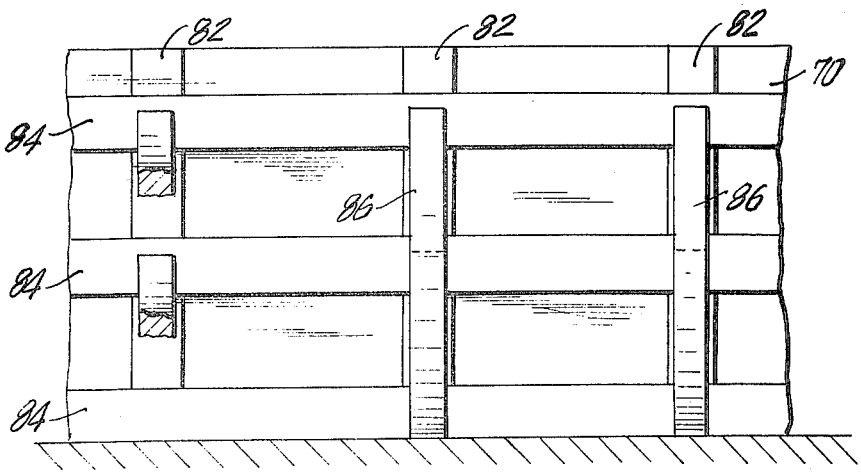
FIG. 5 is a side view taken along line 5—5 in FIG. 3 and illustrating the shoring means employed in the subject invention.

FIGS. 3 through 5 illustrate a vertical concrete structure made according to the subject invention in which both surfaces of the resulting concrete structure are architecturally finished, in that wallboard members are used on the opposed sides of the concrete structure. More particularly, referring to FIG. 3, a plurality of generally vertical extending void creating devices 10 are bonded as at 60 on the opposite sides thereof to opposed, spaced wallboard members 70, 72. The wallboard members may take the form of plywood, particleboard, hardboard, other boards made of wooden products, plasterboard, composite board, or any other architecturally finished structural sheet material. The wallboards 30 (FIGS. 1 and 2) may be made of similar sheets of materials, with the thickness of the wallboards being sufficient to support the structural support requirements of the poured uncured concrete. Reinforcing said wallboard members 70, 72 are shoring means 80 disposed on opposite sides of the planar concrete form defined by the wallboards 70, 72, which shoring means includes the necessary number of vertical 82 and horizontal 84 beam members suitably supported by reinforcing angular members 86, as shown in FIGS. 3 and 5. In addition, the wallboards 70 and 72 may be maintained in spaced relationship by suitable tie rod members (not shown), as is shown in the art in order to maintain said wallboard members 70 and 72 in spaced relationship following the pouring of uncured concrete into the planar concrete form.

As illustrated in FIG. 4, preferably the elongated hollow void creating devices 10, 10 are in interfitting relationship, with the opposed ends of each void creating device 10 being exposed, whereby an internal labyrinth of vertical and horizontal passageways is provided in the resulting concrete structure for receiving and ducting service lines such as electrical, plumbing, sewage, etc. After the wallboards 70, 72 are positioned, and the void creating devices 10 are disposed within the space between said wallboards 70, 72 and bonded to said wallboards, uncured concrete is poured into the concrete forms. The concrete embeds the void creating devices therein, and becomes adhered to the wallboard members 70, 72. After the concrete has cured, the shoring means 80 are removed, and the resulting structure comprises a composite of concrete, embedded void creating devices, and architecturally finished wallboard members 70 and 72 on opposite sides thereof.

In summary, the subject invention provides a single process for producing new and improved architecturally finished concrete structure, and most importantly, achieves that objective without the use of conventional concrete forms. Thus significant cost savings are achieved since less equipment is required, as well as less material and labor in that the subject invention obviates the necessity for additional finishing processes such as applying furring strips and wallboard.

What is claimed is:

1. An architecturally finished concrete structure comprising the combination of:

a finished wallboard member;

a plurality of elongated hollow void creating devices, each of said devices being bonded to one side of the finished wallboard, each said void creating device including opposed pairs of projections that abut with projections extending from adjacent devices; and a concrete structure in intimate contact with both said void creating devices and said one side of said finished wallboard whereby said wallboard forms a finished surface of the resulting concrete structure, while the opposite side of said resulting concrete structure is a continuous slab of concrete.

2. An architecturally finished concrete structure as in claim 1 wherein the ends of said elongated hollow void creating devices are exposed.

3. An architecturally finished concrete structure as in claim 1 wherein said wallboard comprises plaster board.

4. An architecturally finished concrete structure as in claim 1 wherein said finished wallboard comprises wooden material.

5. An architecturally finished concrete structure as in claim 1 wherein said structure is a horizontal ceiling and wherein said finished wallboard is on the lower surface of said ceiling.

6. An architecturally finished concrete structure as in claim 1 wherein a second finished wallboard member is provided and forms the opposed surface of said concrete structure.

7. A method for making a cast-in-place architecturally finished concrete structure comprising the steps of:

bonding a plurality of elongated hollow void creating devices to a finished wallboard member, each said void creating device including opposed pairs of projections that abut with projections extending from adjacent devices;

forming a planar concrete form to define the periphery of the concrete structure, at least one side of which planar form is the finished wallboard member, and with said void creating devices being disposed within said planar concrete form;

forming a concrete structure by pouring uncured concrete into the spaces defined by said planar concrete form thereby embedding the void creating devices therein such that the uncured concrete is in intimate contact with both said void creating devices and with said finished wallboard; and removing said planar concrete form except for said wallboard member which is an integral part of said architecturally finished concrete structure.

8. A method for making a cast-in-place architecturally finished concrete structure as in claim 7 wherein said concrete structure is a vertical wall member, and wherein the step of forming the planar concrete form comprises supporting said wallboard member in a generally vertical disposition, and shoring said member by reinforcing means, and providing a vertical form member spaced from and parallel to said wallboard member, with said void creating devices being disposed between said wallboard member and said form member.

9. A method for making a cast-in-place architecturally finished concrete structure as in claim 7 wherein the step of forming a planar concrete form comprises spacing two finished wallboard members in generally vertical disposition, and shoring said members by reinforcing means.

* * * * *